United States Patent [19]

Heinemann et al.

[11] Patent Number: 4,691,482

[45] Date of Patent: Sep. 8, 1987

[54] ROOF CONSTRUCTION

[75] Inventors: Horst D. Heinemann, Wolfsweg 10, D-5241 Gebhardshain, Fed. Rep. of Germany; Alfred Jost, Wilnsdorf-Niederdilfen, Fed. Rep. of Germany

[73] Assignee: Horst D. Heinemann, Gebhardshain, Fed. Rep. of Germany

[21] Appl. No.: 671,658

[22] Filed: Nov. 15, 1984

[30] Foreign Application Priority Data

Dec. 6, 1983 [DE] Fed. Rep. of Germany ..... 3343984
Jun. 13, 1984 [DE] Fed. Rep. of Germany ..... 3421871

[51] Int. Cl.[4] ..... E04D 12/00; E04D 13/16; E04C 1/78

[52] U.S. Cl. ..... 52/3; 52/22; 52/95; 52/410; 52/747

[58] Field of Search ..... 52/3, 22, 90, 410, 478, 52/486, 489, 518, 520, 522, 94, 404, 408, 409, 741, 747, 748, 514, 302, 303, 95

[56] References Cited

U.S. PATENT DOCUMENTS

| | | | |
|---|---|---|---|
| 3,210,896 | 10/1965 | Detman | 52/22 |
| 4,081,938 | 4/1978 | Bertacchi et al. | 52/410 |
| 4,248,021 | 2/1981 | Dyer | 52/404 |
| 4,277,926 | 7/1981 | Sherman et al. | 52/404 X |
| 4,288,951 | 9/1981 | Carlson et al. | 52/410 X |
| 4,314,428 | 2/1982 | Brownell | 52/22 |
| 4,423,572 | 1/1984 | Tor | 52/522 |
| 4,435,926 | 3/1984 | Struben | 52/3 |
| 4,445,305 | 5/1984 | Orie, Sr. | 52/404 X |
| 4,494,343 | 1/1985 | Berry et al. | 52/410 X |
| 4,495,741 | 1/1985 | Pasiecznik | 52/410 X |

FOREIGN PATENT DOCUMENTS

| | | | |
|---|---|---|---|
| 468740 | 11/1974 | Australia | 52/748 |
| 3128134 | 2/1983 | Fed. Rep. of Germany | |
| 2051910 | 1/1981 | United Kingdom | 52/410 |

*Primary Examiner*—William F. Pate, III
*Assistant Examiner*—Chilcot, R.
*Attorney, Agent, or Firm*—Flynn, Thiel, Boutell & Tanis

[57] ABSTRACT

Conversion of a ventilated roof to a thermally insulated, nonventilated roof without tearing off an existing roof sheathing which is, for example, made of asbestos cement and is carried by roof beams, includes the provision of holes in the old roof sheathing over the length of each roof beam at approximately equal intervals; and the provision of posts which are secured on the roof beams, extend through the holes, and project above the old roof sheathing. A heat-insulating intermediate structure is secured on the posts, has a U-shaped or hat-shaped profile, and extends over the posts which are arranged in a row, on which U-shaped or hat-shaped profile is secured the new roof sheathing. The space between the old and new roof sheathings is filled with an insulating layer.

13 Claims, 6 Drawing Figures

ROOF CONSTRUCTION

FIELD OF THE INVENTION

This invention relates to a roof construction and, more particularly, to a roof construction for converting a ventilated roof to a thermally insulated, non-ventilated roof without tearing off the existing roof sheathing of, for example, asbestos cement which is carried by roof beams.

BACKGROUND OF THE INVENTION

Ventilated roof constructions which already exist and are still being used, can no longer be used, or can be used only in a very limited manner in view of new heat-protection regulations in certain countries. Where one wishes to adjust these existing roofs to meet the new heat-protection regulations, a layer of insulating material which is at least 8 cm thick would have to be built in below the underside of the roof. A disadvantage of such a restoration of an existing roof is that the temperature drop to the wave crest of the corrugated asbestos cement roof, which wave crest lies thereabove, is very small. Through this, the warm air current which is needed for ventilation is too small to remove all moisture, so that physical damage must necessarily occur, as has also been the case when such roof constructions were used for gymnastic and sports halls, even though with a lesser amount of thermal insulation.

A basic purpose of the invention is to change an existing corrugated asbestos roof to a nonventilated roof, namely to a warm roof, with as little expense as possible and without removing the old roof sheathing.

SUMMARY OF THE INVENTION

This purpose is attained by providing holes in the existing sheathing over the length of each roof beam at approximately equal intervals, through which extend posts which are secured on the roof beams and project above the old roof sheathing. An insulating intermediate carrier is secured on the posts, has a U-shaped or a hat-shaped profile, and extends above the posts which are arranged in a row. The new roof sheathing is secured on the U-shaped or hat-shaped profile, and the space between the old sheathing and new sheathing is filled with an insulating layer.

The conversion of an existing ventilated, corrugated asbestos cement roof into a nonventilated warm roof is thus done by providing, along the roof beams which carry the old roof sheathing and at predetermined distances which correspond with the static requirements, holes in the old roof sheathing through which extend posts which are connected to the roof beams. These posts are advantageously constructed as Z-angles, wherein two Z-angles are arranged side by side with opposed orientations and have flanges secured on the roof beam. Through this, one achieves a substantially moment-free force transfer. An insulating intermediate carrier is then screwed onto the posts, which project upwardly beyond the old roof sheathing, on which intermediate carrier is secured a U-shaped or hat-shaped profile which extends over the entire length or width of the roof construction. The insulating intermediate carrier can either include individual insulating pieces which are secured on the individual posts, or can include a through-going thermo-roof beam which in itself forms a space-stable grid carrier, as will be described in greater detail hereinafter. The space between the old roof sheathing and the new roof sheathing, the latter advantageously being made of sheet metal, can then be filled either with a polyurethane foam or with mineral wool. The use of mineral wool will always be preferred when the surrounding temperatures and the moisture are not suitable for the use of polyurethane foam or the demand for a nonburnable roof construction exists.

In the case of roofs with a greater slope, the posts are preferably Z-angles and are not designed with legs arranged at 90° to the center web thereof, but at an angle which corresponds to the roof slope and is greater than 90°, the two legs being parallel to one another in order to meet the existing roof slope. Through this, the load is applied to the roof beam in such a direction that no moment, or only a very small moment, is applied onto the roof beam.

BRIEF DESCRIPTION OF THE DRAWINGS

Two exemplary embodiments of the invention will be described in greater detail hereinafter in connection with the drawings, in which.

DETAILED DESCRIPTION

Figure 1:
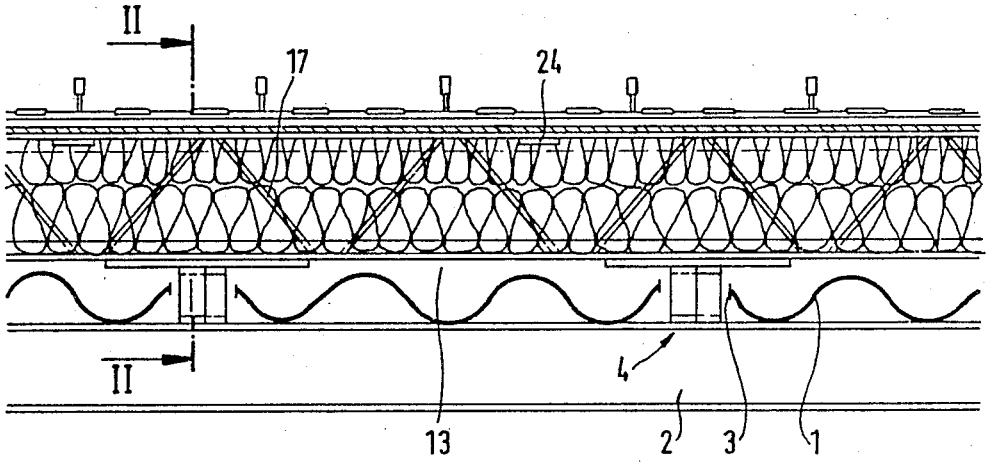
FIG. 1 is a longitudinal sectional side view of an inventive roof construction.
Figure 2:
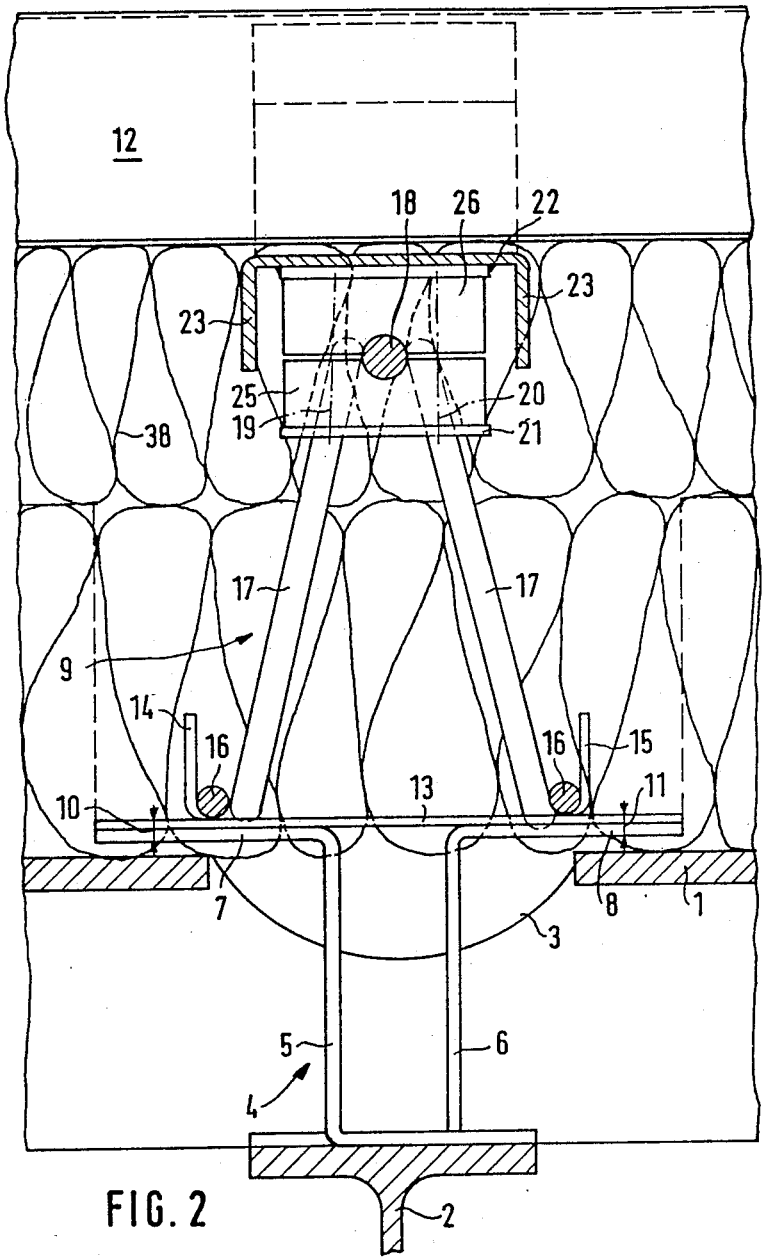
FIG. 2 is a sectional view taken along the line II—II of FIG. 1.
Figure 3:
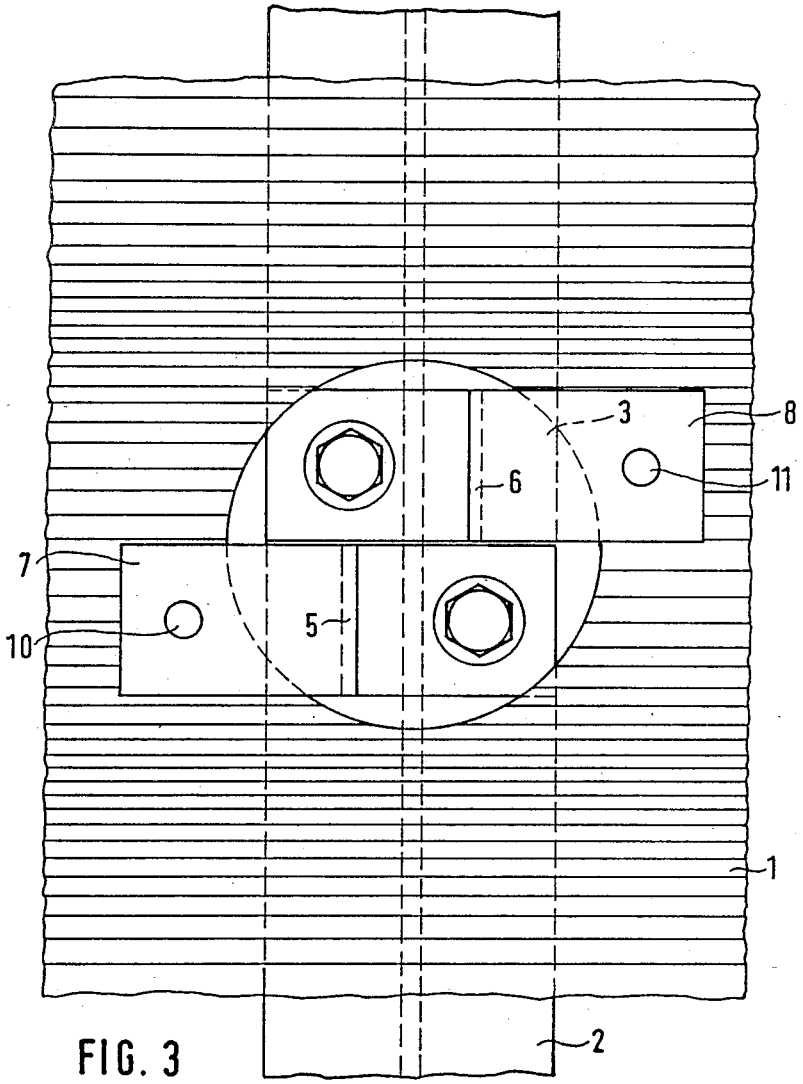
FIG. 3 is a top view of posts which, according to the invention, are connected to the roof beam of an existing roof.

In the exemplary embodiment which is illustrated in FIGS. 1 to 3, an existing roof has sheathing 1, for example of corrugated asbestos cement, which is carried by a roof beam 2 which is in turn supported on supports which are not further illustrated. Round holes 3 are cut into the sheathing 1, as can be seen in the top view in FIG. 3. A post 4 is inserted through each hole 3, which post in the exemplary embodiment is two Z-shaped pieces 5 and 6 (FIG. 2) which are screwed alternately onto the roof beam 2. This has the advantages that, on the one hand, relatively small holes are sufficient and, on the other hand, the load distribution onto the roof beam occurs symmetrically.

The free legs 7 and 8 of the profile pieces 5 and 6 extend over the sheathing 1 and are screwed to an intermediate carrier 9 (FIG. 2) at the points 10 and 11. The intermediate carrier 9 is, in the exemplary embodiment according to FIGS. 1 to 3, a space-sturdy intermediate carrier and has minimal capability for conducting heat from the post to new roof sheathing 12 which is secured thereon. The intermediate carrier 9 has a lower rail 13, which is U-shaped in cross section and has legs 14 and 15 which are directed upwardly. A respective round bar 16 is welded into each corner of the rail 13, which causes the rail 13 to be statically reinforced and to be able to be manufactured of a thin material.

V-shaped rods 17 are welded to each round bar 16 and extend the entire length of the carrier. A longitudinally extending further rod 18 is disposed between and welded to the bends of the rods 17, and extends the entire length of the intermediate carrier 9. The distance between the V-shaped rods 17 is reduced in a side view (FIG. 1), so that through the resulting rectangular support the space-stable intermediate carrier 9 is obtained, which is generally gridlike. The intermediate carrier 9 is distinguished by a high stability in all directions of stress application and by a minimum use of material, wherein the connections of the rail 13 which lies on the bottom to the rod 18 which lies on top occur through relatively small cross sections in comparison to the longitudinal extent of the intermediate carrier. Through this, it is achieved that the carrier, viewed in a building or vertical direction, suffices with only a few relatively small heat bridges. This is of a great advantage for roof constructions which place high demands on thermal insulation.

A U-shaped member 22 is connected to the rod 18 of the intermediate carrier 9 by means of a clamping device which includes screws 19 and 20 and a plate 21. The legs 23 of the member 22 extend downwardly and form abutments for the fastening of the new roof sheathing 12, which in the simplest case is secured by means of clips 24 on the member 22.

The screws 19 and 20 have heads which are accessible from the outside of the member 22, and engage tapholes in the plate 21. Two insulating pieces 25 and 26 are arranged between the member 22 and the plate 21, which insulating pieces 25 and 26 are pressed against the profile rod 18 by the clamping device. Through this, a further insulation of the member 22 relative to the post 4 is obtained and, furthermore, this arrangement permits angular adjustment of the inclination of the member 22 to correspond with the desired slope of the roof with respect to the intermediate carrier 9. Through this, adjustment to various possible slopes of the roof is possible without great difficulty.

The space between the old roof sheathing 1 and the new roof sheathing 12, which in the exemplary embodiment according to FIGS. 1 to 3 is equal to the height of the intermediate carrier, is filled with an insulating layer, which layer can be a polyurethane foam or a mineral fiber insulating material.

It is possible with the inventively constructed roof to set up, without great expense and in particular without removing the existing roof sheathing, a new thermally insulated and unventilated roof construction. Aside from the technical advantages of this construction, in which above the old roof sheathing there is arranged an insulating layer, this construction is effected with simple means and, moreover, the advantage is achieved that activities in the building are not influenced during the reconstruction of the roof.

Figure 4:
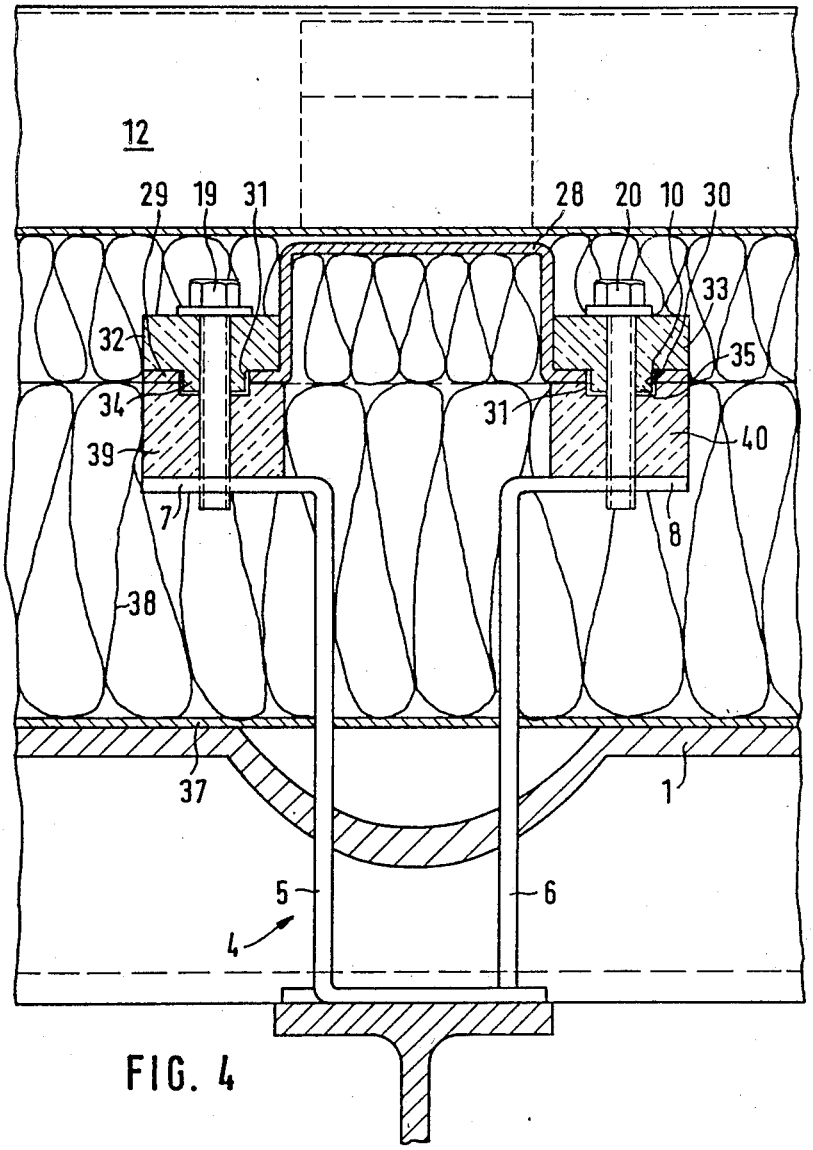
FIG. 4 is a sectional view similar to FIG. 2 of a further embodiment according to the invention.
Figure 5:
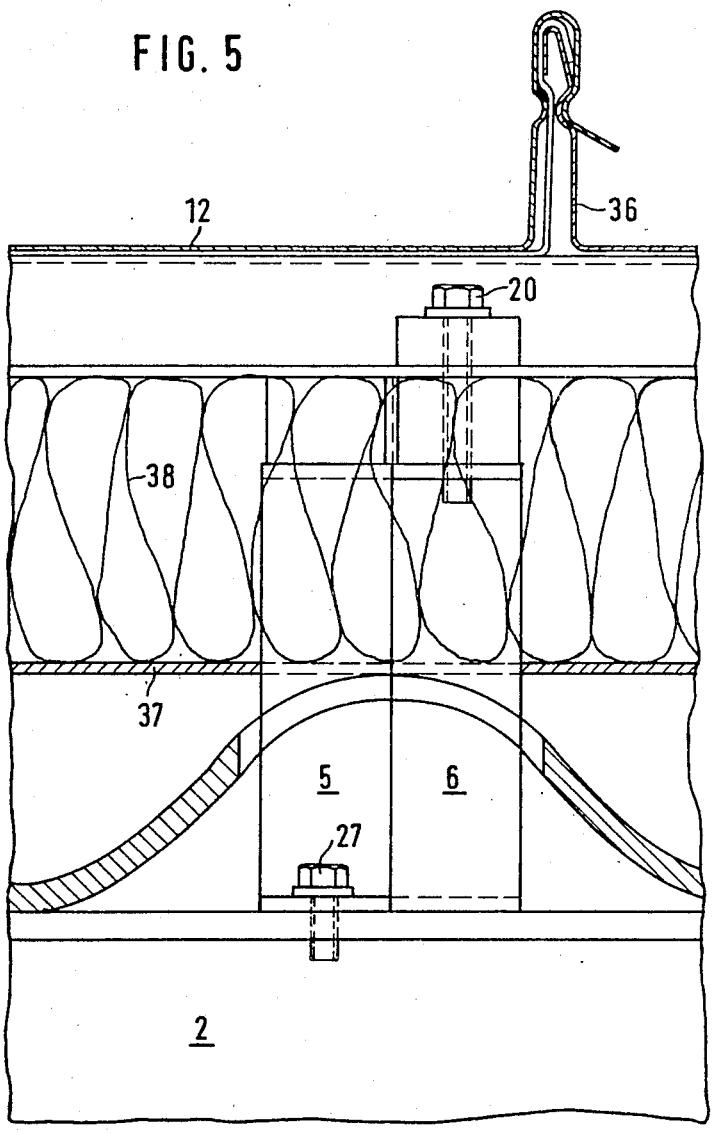
FIG. 5 is a longitudinal sectional view of the inventive roof construction of FIG. 4.

In the exemplary embodiment according to FIGS. 4 and 5, parts corresponding to those in FIGS. 1–3 are provided with the same reference numerals. The exemplary embodiment according to FIGS. 4 and 5 differs from the one according to FIGS. 1 to 3 substantially in that the post 4, which in FIGS. 4 and 5 also includes two Z-shaped profile pieces 5 and 6 connected to the beam 2 by screws 27, is designed taller, so that the legs 7 and 8 extend farther above the roof sheathing 1 than in the exemplary embodiment according to FIGS. 1 to 3. The intermediate carrier 9 is reduced to two insulating pieces 39 and 40, on which is placed a rail 28 which extends the entire length of the roof beam 2 and has a hat-shaped profile. Holes 31 are provided in the laterally angled ends 29 and 30 of the rail 28, through which extend the screws 19 and 20 which are in turn screwed into tapholes in the legs 7 and 8. The screwheads of the screws 19 and 20 engage further insulating pieces 32 and 33, which are each provided with a shoulder 34 or 35 which engages and corresponds in size to the holes 31, so that the screws are not directly connected to the rail 28 and thus cannot form a thermal bridge. The height of the shoulders 34 and 35 is slightly less than the available space so that, during tightening of the screws 19 and 20, the ends 29 and 30 of the cap-shaped rail 28 are tightly clamped in. The new roof sheathing 12 is then clipped onto the cap-shaped rail, after which the space between the old roof sheathing and the new roof sheathing is filled with an insulating material.

With respect to the roof sheathing 12, it preferably includes sheets of metal which, at their edges 36, are angled upwardly and in a conventional manner can be moved one over the other, so that a tight connection between both is obtained. It is also conceivable to place an intermediate plate 37 onto the old roof sheathing 1 when the insulating layer 38 is supposed to have a defined lower end which does not correspond with the wavy surface of the old roof sheathing.

Figure 6:
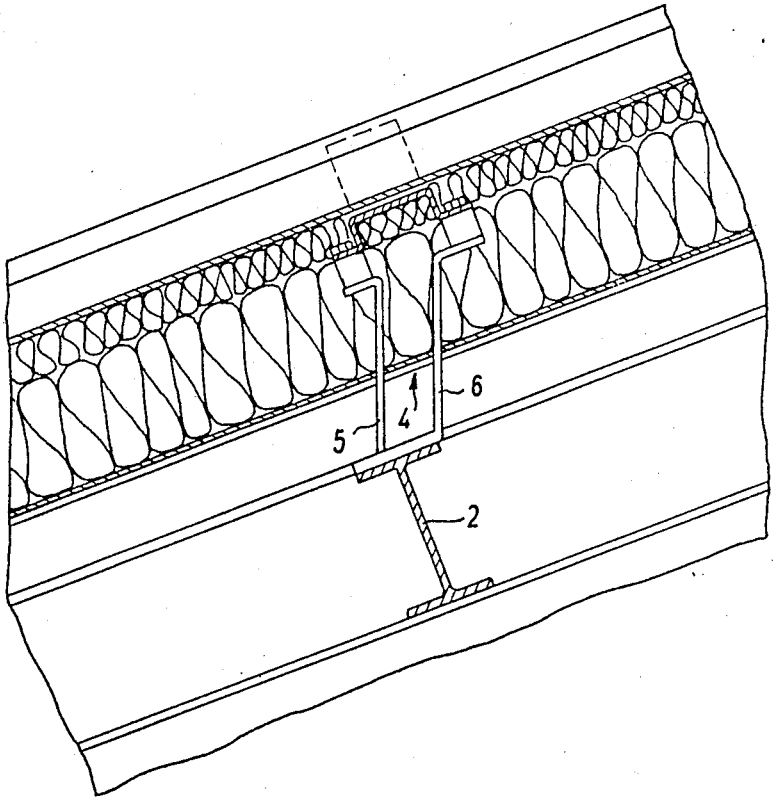
FIG. 6 is a view similar to FIG. 4 which shows a further alternative embodiment having an inclined post.

The further exemplary embodiment which is illustrated in FIG. 6 is substantially identical to that according to FIGS. 4 and 5, with the single change that the post 4, which is again formed of two Z-shaped profile pieces 5 and 6, has angles between its legs which are greater than 90°. Through this, it is achieved that, in the case of more strongly sloped roofs, the force introduction extends through the center of the roof beam 2 and not at a location spaced therefrom, so as to avoid applying a moment onto same. The angle of the legs of the Z-shaped profile pieces can be chosen to correspond to the slope of the roof and to the height of the new roof structure. With this, the otherwise automatic application of force onto the subconstruction with a moment does not exist.

For the inventive roof construction, it is sufficient when using Z-angles to create a hole of 70 mm through the old roof sheathing to the roof beam which lies therebelow. By overcoming the symmetrical load application, for example using Z-shaped angles which are mounted alternately, one achieves a symmetrical load delivery onto the roof beams which lie therebelow. The connection of intermediate carriers, posts and roof beams is done using screw connections, which preferably are rust-free. The new roof sheathing, which preferably includes metal sheets, is applied by means of holding clips to the intermediate carrier. Through the construction of the posts, which if desired can be inclined, it is always assured that the application of forces onto the roof beam occurs in a torque-free manner, namely, symmetrically. In an economical aspect, it has proved to be particularly advantageous that the entire roof structure can be made of premanufactured parts without an influence of the space which is to be provided with the new roof construction occurring.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a roof construction for converting a ventilated roof into a thermally insulted, nonventilating roof without removing an existing roof sheathing which is carried by roof beams, the improvement comprising said existing sheathing having holes therethrough over the length of each roof beam at approximately equal intervals, wherein posts are secured on the roof beams, extend through the holes and project above the existing roof sheathing, wherein an intermediate carrier is secured on the posts, wherein said carrier supports a profile and extends above the posts which are arranged in a row, wherein the intermediate carrier includes insulating means for substantially preventing a flow of thermal energy between the posts and the profile through the intermediate carrier, wherein new roof sheathing is secured on the profile, wherein the carrier, the profile and the new sheathing are substantially completely supported by the posts, and wherein a space between the existing sheathing and the new sheathing is filled with an insulating layer.

2. The roof construction according to claim 1, wherein the post includes two alternately arranged, side-by-side Z-shaped profile pieces.

3. The roof construction according to claim 1, wherein the profile is approximately hat-shaped, and wherein the intermediate carrier includes two insulating pieces which are urged toward one another, between which insulating pieces is clamped an end of the hat-shaped profile.

4. The roof construction according to claim 1, wherein the intermediate carrier includes a rail which serves as a base, on which rail in the region of its edges are secured V-shaped rods, the upper ends of the V-shaped rods being connected to a further rod.

5. The roof construction according to claim 4, wherein the rail includes a U-shaped profile, the legs of which extend toward the further rod.

6. The roof construction according to claim 5, wherein a respective round bar is welded into each corner of the U-shaped profile of the rail, to which round bars are secured the V-shaped rods.

7. The roof construction according to claim 4, wherein the further rod is round and has locking recesses.

8. The roof construction according to claim 4, wherein the profile is a U-shaped rail which is secured on the further rod by a clamping device which is part of the intermediate carrier, and can be fixed at any desired angular position with respect to the rail.

9. The roof construction according to claim 8, wherein the clamping device includes between the U-shaped rail and a plate two insulating pieces, the further rod extending between the insulating pieces.

10. The roof construction according to claim 1, wherein for sloped roof surfaces each post is constructed with a slope corresponding to the slope of the roof surface, so that the force which is applied by the new roof sheathing to the roof beam is directed approximately centrally with respect to the roof beam.

11. A method for converting a ventilated roof into a thermally insulated, nonventilating roof without removing an existing roof sheathing which is carried by roof beams, comprising the steps of: creating holes through the existing roof sheathing over the length of each roof beam at approximately equal intervals; providing posts which are secured on the roof beams, extend through the holes, and project above the old roof sheathing; securing on the posts an insulating intermediate carrier which supports a profile and extends over the posts which are arranged in a row; securing new roof sheathing on the profile, the carrier, the profile and the new sheathing being substantially completely supported by the posts, and the intermediate carrier including insulating means for substantially preventing a flow of thermal energy between the profile and the posts through the intermediate carrier; and providing in the space between the old sheathing and new sheathing an insulating layer.

12. The roof construction according to claim 1, wherein the existing roof sheathing includes corrugated asbestos cement plates.

13. The roof construction according to claim 1, wherein said profile is U-shaped.

* * * * *